United States Patent [19]

Wommelsdorf

[11] 4,170,172

[45] Oct. 9, 1979

[54] METHOD AND APPARATUS FOR MAKING ROLLED CONTAINERS

[75] Inventor: Fritz Wommelsdorf, Hamburg, Fed. Rep. of Germany

[73] Assignee: Maschinenfabrik Rissen GmbH, Hamburg, Fed. Rep. of Germany

[21] Appl. No.: 843,245

[22] Filed: Oct. 18, 1977

[30] Foreign Application Priority Data

Oct. 30, 1976 [DE] Fed. Rep. of Germany ..... 2650097

[51] Int. Cl.[2] ..... B31C 7/02

[52] U.S. Cl. ..... 93/94 FC; 93/39.3; 93/79

[58] Field of Search ..... 93/39.3, 79, 94 FC

[56] References Cited

U.S. PATENT DOCUMENTS

| | | | |
|---|---|---|---|
| 3,468,226 | 9/1969 | England et al. | 93/94 FC X |
| 3,605,573 | 9/1971 | Buhle | 93/94 FC X |

*Primary Examiner*—E. F. Desmond

*Attorney, Agent, or Firm*—Prutzman, Kalb, Chilton & Alix

[57] ABSTRACT

A conical mandrel rotatable at a first station for rolling a precut paper-like container blank into a conical shape and having two separate, angularly spaced and axially extending rows of vacuum retention ports timely connected to a low pressure source via an axially shiftable control valve within the mandrel for vacuum retention of the leading and trailing edges of the rolled container blank as it is rolled and while the mandrel is indexed to a sealing station where overlapping leading and trailing edge portions of the rolled container blank are sealed together.

4 Claims, 6 Drawing Figures

METHOD AND APPARATUS FOR MAKING ROLLED CONTAINERS

BRIEF SUMMARY AND BACKGROUND OF THE INVENTION

The present invention relates generally to method and apparatus for making containers from precut blanks of paper-like material by rolling a precut blank and sealing angularly overlapping end portions of the rolled container blank and more particularly to new and improved method and apparatus of the type described employing a rotatable mandrel for rolling a precut container blank at a first station of the mandrel and for retaining the rolled container blank thereon for sealing overlapping end portions thereof at a second different station of the mandrel.

It is a primary aim of the present invention to provide new and improved method and apparatus for rolling and sealing container blanks of paper-like material.

It is another aim of the present invention to provide a new and improved paper container machine for rolling a paper-like container blank onto a mandrel at a first station of the mandrel and for sealing overlapping end portions of the rolled container blank at a subsequent station of the mandrel. In accordance with the present invention, an indexing table having an annular arrangement of a plurality of mandrels and adapted to be periodically indexed, is employed for indexing each mandrel to successive rolling and sealing stations.

It is another aim of the present invention to provide new and improved method and apparatus for forming a longitudinal container seam in overlapping end portions of a rolled container blank of paper, synthetic material or the like. The present invention has notable use in rolled paper-like container manufacturing systems, in which a time interval is provided between the rolling and sealing steps. In the past, the overlapping end portions of a rolled container blank have been held, for example as described in the Federal Republic of Germany Patent, GT No. 1,288,416 with clamps associated and rotated with a rolling mandrel and mechanically operated independently of a sealing cheek or blade operated for sealing the overlapping end portions together. The provision of such clamps and the mechanism required for operating the clamps is expensive, and in accordance with the present invention, such clamps are replaced by vacuum retention means for holding the overlapping end portions of the rolled blank in position for sealing. For that purpose, a container rolling mandrel is provided with two angularly spaced axially extending rows of vacuum ports for separate vacuum retention of the two overlapping ends of a container blank as it is rolled onto the mandrel and whereby the overlapping ends are held in position to be sealed as desired, for example, at a succeeding sealing station to which the mandrel is indexed. When the mandrel is rotated to roll a precut container blank onto the mandrel, a leading edge of the precut container blank is initially held in place against the mandrel by a row of low pressure or vacuum ports timely connected to a suitable low pressure source. A second row of low pressure ports is arranged on the mandrel adjacent to but angularly spaced from the leading edge row of ports for retaining the trailing edge of the container blank against the mandrel after the paper-like container blank has been rolled onto the mandrel. The trailing edge row of vacuum ports are likewise timely connected to the low pressure source after the leading edge row of ports and so as to avoid reducing the vacuum retention of the leading edge of the container blank.

Thus, according to the present invention, each of two rows of vacuum retention ports of the mandrel are selectively connected to a low pressure source so that the leading edge row of vacuum ports is effective as soon as the container blank rolling operation begins, and the trailing edge row of vacuum retention ports is effective at the earliest after the leading edge row of ports is covered by the container blank and at the latest after the container blank rolling step is completed and before a roll guide for the blank is withdrawn. Furthermore, the two rows of retention ports are selectively connected to a low pressure source in accordance with the invention so that the rolled paper-like container blank is firmly held on the mandrel until overlapping edge portions thereof have been effectively sealed together.

A better understanding of the invention will be obtained from the following detailed description and the accompanying drawings of an illustrative application of the invention.

DESCRIPTION OF THE PREFERRED EMBODIMENT

Figure 1:
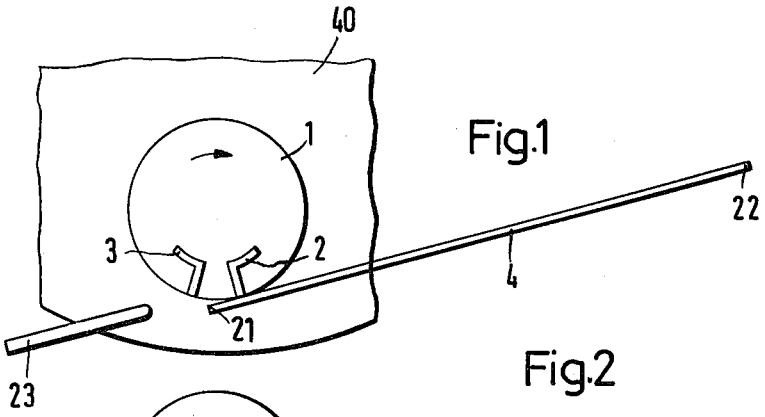
FIG. 1 is a generally diagrammatic partial end view of a rolled paper container machine incorporating the present invention and showing a rotatable mandrel thereof and a precut paper container blank at the beginning of a rolling cycle.
Figure 2:
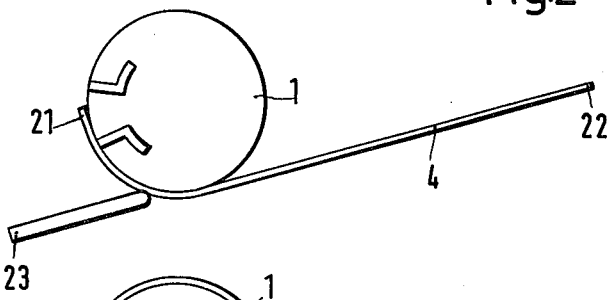
FIGS. 2–4 are diagrammatic partial end views of the rolled paper container machine similar to FIG. 1, showing respectively the rotatable mandrel and precut paper container blank at a rolling station of the mandrel at an intermediate stage and end of the rolling cycle, and at a subsequent sealing station of the mandrel.
Figure 3:
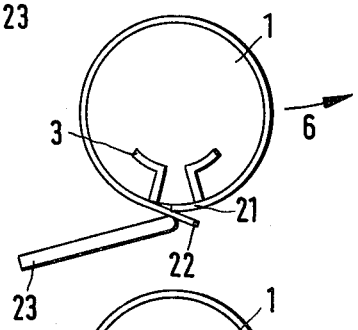

Referring now to the drawings in detail, a rolled paper container machine according to the present invention comprises one or more mandrel assemblies mounted in an annular arrangement on a suitable rotatable indexing table 40 (partly shown in FIG. 1) for indexing each mandrel assembly to a container rolling station shown diagrammatically in FIGS. 1–3 where a precut container blank 4 of suitable paper or paper-like synthetic material is rolled on a rotatable mandrel 1 of the mandrel assembly. After the precut container blank is rolled on the mandrel 1 as hereinafter more fully described, the mandrel 1 is indexed from the rolling station to a sealing station shown diagrammatically in FIG. 4, where the overlapping ends 21, 22 of the rolled container blank 4 are suitably secured together to form a longitudinally extending seam along the formed container tube. The container tube may then be withdrawn from the mandrel 1 either at the sealing station or at a subsequent station to which the mandrel is indexed by its supporting table 40.

Referring to FIG. 1, a precut container blank 4 is rolled onto the mandrel 1 by initially positioning the mandrel 1 and blank 4 so that the leading edge 21 of the precut container blank 4 engages and overlaps a leading edge row of vacuum ports 2 of the mandrel 1. More particularly, the leading edge 21 of the precut blank 4 is positioned to overlap the leading edge row of vacuum ports 2 to extend substantially but not completely to a second row of vacuum ports 3 angularly spaced from the leading edge row of vacuum ports 2 approximately equal to but slightly greater than the angular width of the container seam to be formed. As more fully explained hereinafter, the leading edge row of vacuum ports 2 are connected to a suitable low pressure source (not shown) during the entire rolling operation for vacuum retention of the leading edge 21 of the container blank 4 against the mandrel 1 and thereby permit the mandrel 1 to withdraw the paper blank 4 onto the mandrel 1 and roll the blank 4 into the desired container tube form as the mandrel 1 is revolved (in a clockwise angular direction as shown in FIGS. 1–3) one full revolution from its initial angular position shown in FIG. 1 to its final position shown in FIG. 3. After the mandrel 1 has been rotated an initial angle of approximately 45°, a suitable guide or drag blade 23 having a rounded edge engageable with the paper blank 4 is shifted from a withdrawn position shown in FIG. 1 into light frictional contact with the blank 4 as shown in FIG. 2 to assist in firmly retaining the blank 4 against the mandrel 1 as it is rolled on the mandrel 1 to form the desired containter tube form. The blade 23 is held in light frictional contact with the paper blank 4 during the remainder of the full revolution of the blank rolling cycle and is withdrawn after the rolled container tube 4 is fully formed and is vacuum retained in that form against the mandrel 1. The mandrel 1 and rolled container tube are then indexed to the succeeding station by the indexing table 40 (and if desired, a following mandrel (not shown) is simultaneously indexed to the rolling station for rolling a succeeding precut paper blank).

Figure 4:
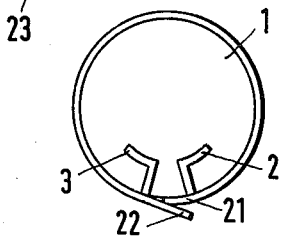

After the mandrel 1 has been rotated substantially a full revolution, the trailing edge row of vacuum ports 3 is covered by the trailing edge 22 of the rolled paper blank 4 and the trailing edge ports 3 are thereupon effective in vacuum retaining the trailing edge 22 of the blank against the mandrel 1 shown in FIGS. 3 and 4. As hereinafter more fully described, the trailing edge row of vacuum ports 3 are timely connected to a low pressure source for effecting vacuum retention of the trailing edge 22 of the blank without reducing the low pressure source and the effectiveness of the leading edge row of vacuum retention ports 2 in holding the leading edge 21 of the paper blank 4 against the mandrel 1.

After the precut paper blank is rolled on the mandrel 1 and held in position on the mandrel with the leading and trailing edge rows of ports 2, 3, the mandrel 1 is indexed by its support table 40 in the direction of the arrow 6 shown in FIG. 3 to withdraw the mandrel 1 from the blade 23. The blade 23 is suitably mounted on the machine frame to remain at the rolling station and so that the mandrel 1, when at the rolling station, is in close proximity to the blade 23. Also, the blade 23 is mounted to be shifted slightly, generally tangentially to the mandrel 1, from its withdrawn position shown in FIG. 1 into engagement with the rolled container blank 4 as shown in FIG. 2.

The mandrel 1 provides for firmly holding the rolled paper blank in position at the sealing station shown in FIG. 4 with the two rows of vacuum retention ports 2, 3. Also, as shown in FIG. 4, the trailing edge 22 of the paper blank is permitted to extend generally tangentially from the trailing edge row of ports 3 to provide access between the overlapping portions of the leading and trailing edges 21, 22 as may be desired for sealing purposes. A suitable sealing mechanism (not shown) is provided at the sealing station for sealing the overlapping ends 21 and 22 together for effecting a suitable structural seam along the length of the formed paper container tube. Accordingly, the seam is sealed at a station spaced from the rolling station and blade 23 and whereby the sealing mechanism (not shown) has complete access to the overlapping ends of the rolled container blank for sealing the ends together.

Any suitable sealing mechanism may be employed for sealing the overlapping ends of the rolled container blank and if desired the opposing faces of the overlapping portions of the leading and trailing edges of the precut container blank 4 may be pretreated as desired for the sealing operation.

Figure 6:
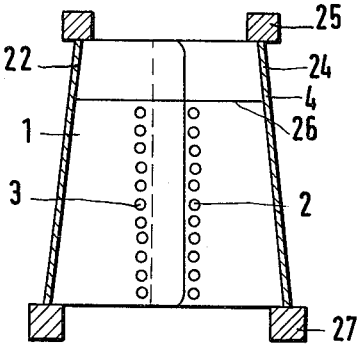
FIG. 6 is a generally diagrammatic longitudinal sectional view, partly in section showing a pair of alignment rings for aligning a rolled paper container on the mandrel.
Figure 5:
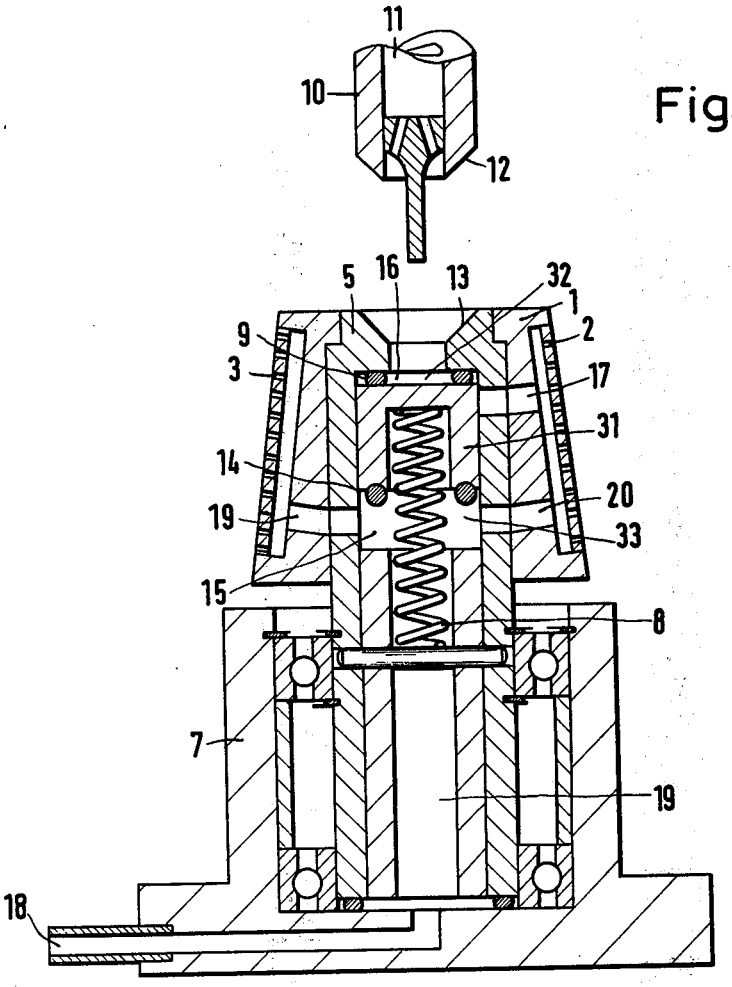
FIG. 5 is a partial longitudinal section view, partly broken away and partly in section, showing a mandrel assembly of the rolled paper container machine at a mandrel rolling station in alignment with a mandrel operator of the machine.

Although the two rows of vacuum retention ports 2, 3 are illustrated in FIG. 5 to appear to have a 180° separation, the two rows of vacuum ports 2, 3 are angularly spaced approximately 30 to 45 degrees as diagrammatically shown in FIGS. 1–4 and preferably so as to have an angular spacing approximately equal to but slightly greater than the angular width of the seam formed by the overlapping leading and trailing edge portions of the rolled container tube. Also, the mandrel 1 is shown having a truncated conical shape, for example for rolling a precut container blank into a truncated conical shape with the rolled container tube extending axially beyond the upper face 26 of the mandrel 1 as shown in FIG. 6.

Referring to FIG. 5, the mandrel 1 is suitably secured onto an elongated spindle 5 rotatably mounted within a cylindrical opening of a mandrel support socket 7. The mandrel support socket 7 is mounted on the mandrel indexing table 40 for indexing the mandrel assembly from station to station as described. The spindle 5 has an axially extended air passageway 19 and an upper enlarged cylindrical bore 15 for a cylindrical slide valve 31. The slide valve 31 is normally held in its outer or extended position by an internal compression spring 8 with an outer O-ring 9 of the valve 31 in sealing engagement with the spindle 5. In that position the valve 31 provides for connecting the central air passageway 18 to both rows of ports 2, 3 via radial passageways 19, 20 in the spindle 5 and mandrel 1 connecting the lower end 33 of the valve bore 15 to respective axially extending passageways underlying and in communication with the rows of vacuum ports 2, 3. The air passageway 19 is connected via an inlet conduit 18 and a suitable mandrel control valve (not shown) to a low pressure source and the control valve is automatically timely opened during rotation of the mandrel 1 at the rolling station for connecting the low pressure source to the inlet conduit 18.

After a mandrel 1 is indexed to the winding or rolling station, a vertically reciprocable mandrel operator 10 in axial alignment with the mandrel assembly is axially shifted downwardly to seat its conical male end 12 against a conforming female conical end 13 of the spindle 5. An axially extending air passageway 11 in the mandrel operator 10 is thereby connected to an upper end 32 of the valve chamber 15 and a central, axially extending projection of the mandrel operator 10 engages and shifts the valve 31 to disconnect the lower end 33 of the valve chamber from the radial passageways 19, 20 with the lower valve O-ring seal 14. Also, the mandrel operator 10 thereby provides for simultaneously connecting its internal passageway 11 with the row of leading edge ports 2 via a radial passageway 17 in that spindle 5 and mandrel 1 while disconnecting the leading and trailing edge rows of ports 2, 3 from the central spindle passageway 19. The passageway 11 of the mandrel operator 10 is also connected via a suitable control valve (not shown) to the low pressure source (not shown) and that control valve is automatically operated to connect the leading edge row of ports 2 to the low pressure air source after the operator 10 is lowered into engagement with the mandrel assembly and just prior to the commencement of the container blank rolling operation.

The mandrel 1 is then rotated as described for rolling the precut blank 4 on the mandrel 1, and for example, with the mandrel being rotated by the mandrel operator 10 through the frictional engagement of their male and female conical ends 12, 13. Also, during the one revolution rolling cycle, the mandrel control valve (not shown) for the inlet conduit 18 is suitably automatically operated for automatically connecting the low pressure source to both the leading edge and trailing edge rows of ports 2, 3 when the mandrel operator 10 is withdrawn. And, after the mandrel 1 has been rotated one revolution, the mandrel operator 10 is quickly withdrawn to permit the slide valve 31 to be shifted upwardly quickly to simultaneously connect the leading and trailing edge rows of ports 2, 3 to the low pressure source via the central air passageway 19. The valve 31 thereby prevents momentary loss of the vaccum retention of the leading edge 21 of the rolled container tube. Also, when the mandrel operator 10 is withdrawn, its control valve (not shown) is automatically timely closed to prevent any substantial vacuum loss through the air passageway 11.

The air conduit 18 remains connected to the low pressure source as the mandrel assembly is indexed to the succeeding sealing station where the wound or rolled container tube is sealed. After the container is properly sealed, the control valve (not shown) for the air conduit 18 is automatically closed to permit the formed container tube to be withdrawn from the mandrel 1. That control valve is thereafter opened during the next rolling cycle after the mandrel 1 has been indexed to the rolling station and the slide valve 31 has been shifted downwardly to close the lower end 33 of the valve chamber 15.

Referring to FIG. 6, provision is shown for aligning the rolled container tube on the mandrel 1 preferably after the mandrel 1 is indexed from the rolling station. In that regard, although the vacuum retention provided by the ports 2, 3 provides for securely retaining the leading and trailing edges of the rolled container blank against the mandrel, the vacuum retention is adapted to be set or adjusted so that the rolled container tube can be axially shifted slightly on the mandrel 1 without releasing the container tube from the mandrel. For example, a ring 25 can be lowered into engagement with the upper edge of the rolled container tube to axially shift either end 21, 22, if misaligned, downwardly and to thereby square the upper edge of the rolled container tube. Accordingly, if the blank is wound slightly skewed, the ring 25 would engage the skewed end to shift it downwardly to properly align the rolled paper tube on the mandrel. The ring 25 could also be used to shift the rolled paper tube on the mandrel 1 to provide a uniform container tube size and diameter.

In addition, if the lower large diameter end of the rolled paper tube is to be accurately sized, for example, for use in subsequent container processing, and/or if the length of the rolled tubes vary due to length variations in the container blanks, an additional lower abutment or alignment ring 27 may be used in combination with the alignment ring 25. In that event, the alignment ring 25 could be used for shifting the rolled container tube into engagement with the abutment ring 27 to effect the desired alignment of its lower edge before sealing. Also, where a container tube is rolled which does not project axially beyond the upper surface 26 of the mandrel 1 as shown in FIG. 6, an upper ring larger than the mandrel diameter and having suitable inwardly projecting alignment pins adapted to be received in corresponding axially extending grooves (not shown) in the mandrel 1 would be employed for engaging and axially shifting the upper edge of the rolled container tube.

As will be apparent to persons skilled in the art, various modifications, adaptations and variations of the foregoing specific disclosure can be made without departing from the teachings of the present invention.

I claim:

1. In a method of rolling a paper-like container blank into a rolled tubular container part on a rotating mandrel and with the tubular container port having inner and outer angularly overlapping edge portions, and sealing the overlapping edge portions together to form a container tube seam therewith, the improvement wherein the method comprises the steps of rotating the mandrel at a first rolling station thereof and rolling a said paper-like container blank on the mandrel and into a said rolled tubular container part by initially vacuum retaining only a leading edge of the container blank against the mandrel by connecting only leading edge vacuum retention ports in the mandrel to a vacuum source and subsequently vacuum retaining only an additional trailing edge of the container blank against the mandrel after the container blank is rolled thereon into said rolled tubular container part by additionally connecting only trailing edge vacuum retention ports in the mandrel to a vacuum source and whereupon said rolled tubular container part is retained in the mandrel by vacuum retention of only its leading and trailing edges, and, with the rolled tubular container part retained on the mandrel by such vacuum retention of only the leading and trailing edges thereof, indexing the mandrel to a sealing station and sealing the overlapping edge portions of the rolled container part together to form a said container tube seam.

2. In a rolled paper container tube machine having a mandrel assembly with a mandrel for rolling a paper-like blank into a rolled tubular part having inner and outer angularly overlapping edge portions adapted to be sealed together to form a generally axially extending tube seam, the mandrel comprising angularly spaced and axially extending leading edge and trailing edge vacuum port means for vacuum retention of the leading and trailing edges respectively of the rolled tubular part against the mandrel on opposite sides of and adjacent to said overlapping edge portions, a mandrel base rotatably supporting the mandrel for rolling a said paper-like blank thereon, a rotatable mandrel indexing table supporting the mandrel base and angularly indexable for indexing the mandrel assembly to rolling and sealing stations thereof in sequence, and control means for rotating the mandrel for rolling a said blank thereon and for connecting the leading edge and trailing edge vacuum port means to a low pressure source for vacuum retention of the leading and trailing edges of the blank against the mandrel as the blank is rolled into a said tubular part on the mandrel, the improvement wherein the control means is operable for connecting the leading edge vacuum port means to a low pressure source separately from the trailing edge vacuum port means for vacuum retention of the leading edge of the blank against the mandrel as the blank is rolled on the mandrel into a said tubular part and for thereafter connecting both the trailing edge and leading edge vacuum port means to a low pressure source approximately after the trailing edge of the blank is rolled on the mandrel to overlap the trailing edge port means, the control means providing for maintaining the leading and trailing edge vacuum port means connected to the low pressure source for firmly retaining the rolled tubular part on the mandrel until the mandrel indexing table is indexed to the sealing station and the overlapping edge portions of the rolled tubular part are sealed together to form a tube seam.

3. In a rolled paper container tube machine having a mandrel assembly with a mandrel for rolling a paper-like blank into a rolled tubular part having inner and outer angularly overlapping edge portions adapted to be sealed together to form a generally axially extending tube seam, the mandrel comprising angularly spaced and axially extending leading edge and trailing edge vacuum port means for vacuum retention of the leading and trailing edges respectively of the rolled tubular part against the mandrel on opposite sides of and adjacent to said overlapping edge portions, a mandrel base rotatably supporting the mandrel for rolling a said paper-like blank thereon, and control means for rotating the mandrel for rolling a said blank thereon and for connecting the leading edge and trailing edge vacuum port means to a low pressure source for vacuum retention of the leading and trailing edges of the blank against the mandrel as the blank is rolled on the mandrel into a said tubular part, the improvement wherein the control means comprises a mandrel operator in axial alignment with the mandrel and having a low pressure source conduit and axially shiftable into engagement with the mandrel assembly for connecting the low pressure source conduit to the leading edge port means for vacuum retention of a leading edge of a said blank against the mandrel as the blank is rolled on the mandrel.

4. In a rolled paper container tube machine having a mandrel assembly with a mandrel for rolling a paper-like blank into a rolled tubular part having inner and outer angularly overlapping edge portions adapted to be sealed together to form a generally axially extending tube seam, the mandrel comprising angularly spaced and axially extending leading edge and trailing edge vacuum port means for vacuum retention of the leading and trailing edges respectively of the rolled tubular part against the mandrel on opposite sides of and adjacent to said overlapping edge portions, a mandrel base rotatably supporting the mandrel for rolling a said paper-like blank thereon, and control means for rotating the mandrel for rolling a said blank thereon and for connecting the leading edge and trailing edge vacuum port means to a low pressure source for vacuum retention of the leading and trailing edges of the blank against the mandrel as the blank is rolled on the mandrel into a said tubular part, the improvement wherein the mandrel assembly comprises first conduit means adapted to be connected to a low pressure source and a valve shiftable between a first operating position connecting the first conduit means to both leading and trailing edge port means and a second operating position disconnecting the first conduit means therefrom, and wherein the tube machine comprises mandrel operating means having second conduit means adapted to be connected to a low pressure source and to the leading edge port means only with the valve in its second position, the mandrel operating means being operable for rotating the mandrel at least one revolution for rolling a blank thereon and for holding the valve in its second position to connect the second conduit means to the leading edge port means only while the blank is rolled thereon and for shifting the valve to its first position after the blank is substantially rolled on the mandrel.

* * * * *